US005477219A

United States Patent [19]

Zarembo et al.

[11] Patent Number: 5,477,219

[45] Date of Patent: Dec. 19, 1995

[54] COMPOSITE ELECTRONIC ARTICLE SURVEILLANCE, IDENTIFICATION, AND SECURITY MARKER ASSEMBLY AND SYSTEM

[75] Inventors: Peter J. Zarembo, Shoreview; Walfredo M. Marfori, Cottage Grove, both of Minn.

[73] Assignee: Minnesota Mining and Manufacturing Company, St. Paul, Minn.

[21] Appl. No.: 414,052

[22] Filed: Mar. 30, 1995

Related U.S. Application Data

[63] Continuation of Ser. No. 85,289, Jun. 30, 1995, abandoned.

[51] Int. Cl.[6] ..... G08B 13/14

[52] U.S. Cl. ..... 340/572; 340/571; 340/551; 340/825.34; 340/825.35; 359/537

[58] Field of Search ..... 340/572, 551, 340/568, 571, 825.34, 825.35; 359/538, 546, 537; 380/105, 109, 106, 107; 364/466, 478; 382/12, 6.9

[56] References Cited

U.S. PATENT DOCUMENTS

| | | | |
|---|---|---|---|
| 3,801,183 | 4/1974 | Sevelin et al. | 359/537 |
| 4,099,838 | 7/1978 | Cook et al. | 359/537 |
| 4,120,704 | 10/1978 | Anderson | 340/572 |
| 4,652,863 | 3/1987 | Hultman | 340/551 |
| 4,967,185 | 10/1990 | Montean | 148/103 |
| 5,059,951 | 10/1991 | Kaltner | 340/572 |
| 5,151,684 | 9/1992 | Johnsen | 340/572 |

*Primary Examiner*—John K. Peng
*Assistant Examiner*—Benjamin C. Lee
*Attorney, Agent, or Firm*—Gary L. Griswold; Walter N. Kirn; Kari H. Bartingale

[57] ABSTRACT

A composite marker providing electronic article surveillance (EAS), identification, and authentication. The marker preferably includes an EAS detection element which includes a low-coercive force, high-permeability ferromagnetic material, and an adjacent, remanently-magnetizable ferromagnetic material which, when magnetized, alters a characteristic response produced by the first material when in an interrogation zone of an associated EAS system, an intermediate layer containing UPC or similar optically-readable information and a substantially-transparent, optically-detectable security element overlying said intermediate layer and having means integrally associated therewith for thwarting counterfeiting or other unauthorized duplication.

9 Claims, 2 Drawing Sheets

FIG.1
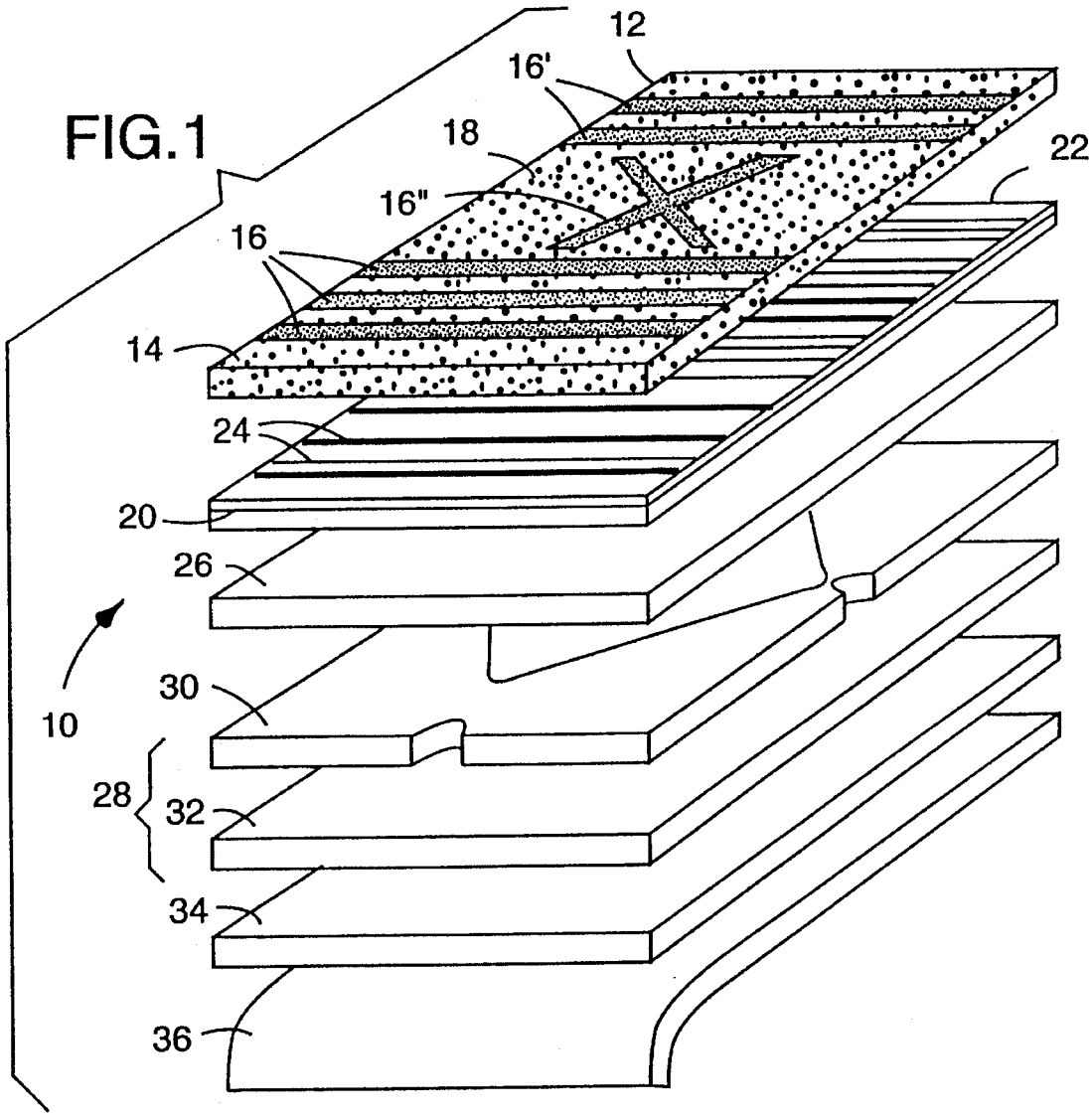
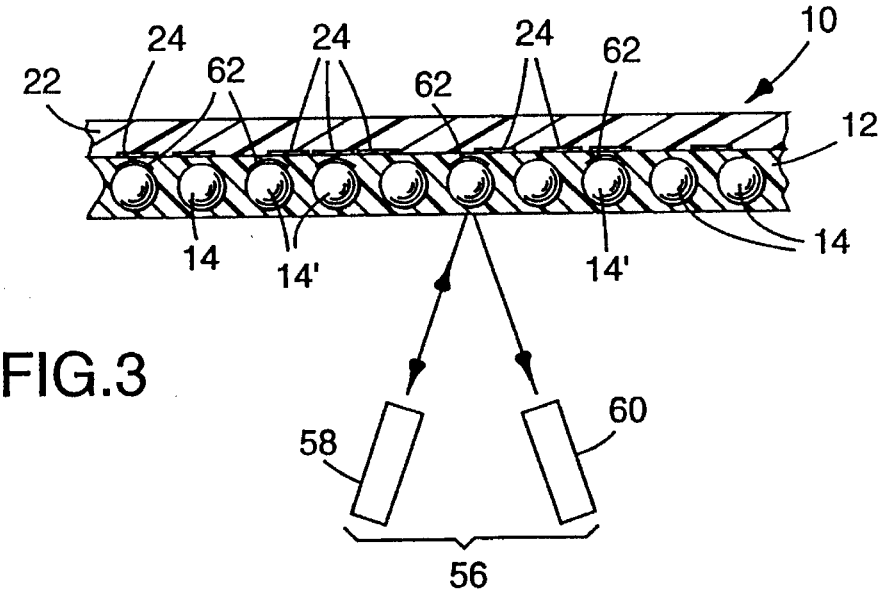
FIG.3

COMPOSITE ELECTRONIC ARTICLE SURVEILLANCE, IDENTIFICATION, AND SECURITY MARKER ASSEMBLY AND SYSTEM

This is a continuation of application Ser. No. 08/085,289 filed Jun. 30, 1993 now abandoned.

TECHNICAL FIELD

This invention relates to markers and/or labels and associated systems for protecting articles from theft, for identifying them and/or for authenticating them.

BACKGROUND OF THE INVENTION

The unauthorized removal of articles such as that of taking books from libraries without checking them out is an ever-increasing problem, both in general societal terms and in terms of expense to the taxpayer and impairment of the information services provided by public libraries. In addition, there have been several noted recent instances of theft of relatively rare and valuable books from libraries. With limited resources, libraries cannot afford to lose any books, much less books that are essentially irreplaceable. In the commercial setting, retail stores have an obvious requirement to control shoplifting of expensive inventory such as designer clothing, prerecorded video movies, drugs, etc., which, of necessity, are displayed openly and are accessible to both the bona fide patron/customer and the would-be shoplifter.

Electronic article surveillance (EAS) systems for controlling pilferage, especially the unauthorized taking of books from libraries and book stores, are well known. One type of such EAS system employs ferromagnetic markers attached to the article. If the article is to be permanently marked to control its passage, a single-status, non-deactivatable marker will be used.

Alternatively, if the article is intended for authorized removal, a deactivatable, dual-status marker will be used. In the latter event, if the marker is not deactivated when the article is properly removed, the marker will be detected as the article is passed through the interrogation zone of the EAS system. A single status marker would also be so detected. More particularly, the interrogation zone is established by spaced apart detection panels placed across the exits. The panels include field coils for producing an alternating magnetic field across the exits and detector coils for detecting the passage of a marker between the panels.

It is also known to provide means for thwarting the counterfeiting of security or copyright-protected articles by marking such articles with non-removable labels containing indicia not visible via ordinary inspection and/or which is not reproducible except with sophisticated manufacturing equipment. One such technique utilizes labels containing retroreflective indicia visible only via hand-held retroreflective viewers. See, for example, U.S. Pat. No. 4,099,238 (Cook et al.).

Furthermore, it is also known to use optically detectable identification labels, such as the ubiquitous UPC product identification/price codes, to identify articles and to conceal such labels below transparent security layers.

SUMMARY OF THE INVENTION

To avoid limitations attendant the various previously-known techniques acknowledged above, the present invention is directed to a composite marker assembly adapted to be secured to an article and which, in concert, affords article protection from theft, authenticates the article to prevent counterfeiting and at the same time integrates an identification element such as a UPC-type label for inventory control.

A first portion of the marker assembly thus comprises an identification element bearing optically readable information indicative of the article to which the marker is to be secured. The marker assembly also includes a substantially transparent, optically detectable security element overlying the identification element and having means integrally associated therewith for thwarting counterfeiting or other unauthorized duplication. Finally, the assembly includes a dual-status deactivatable electronic article surveillance (EAS) detection element positioned beneath the identification element and having a first, activated state at which the element is adapted to be detected within an interrogation zone of the system and having a second, deactivated state at which such detection is prevented.

The assembly, thus enables the information borne by the information element to be optically read, the authenticity of the security element to be determined, and the status of said detection element to be determined and/or altered. A certain response to any one of the operations allows the other operations to be modified.

Preferably, the security element comprises a sheet of substantially transparent retroreflective microspheres, portions of which microspheres have been differently treated to alter the degree of retroreflectivity so as to provide retroreflective legend areas and retroreflective background areas which are substantially indistinguishable under ordinary viewing conditions, but are clearly distinguishable under retroreflective viewing conditions.

In a further preferred embodiment, the detection element of the marker assembly comprises a responder section of high-permeability, low-coercive force ferromagnetic material and a keeper section of remanently magnetizable ferromagnetic material which, when magnetized, alters a characteristic response produced by said responder section when in a said interrogation zone of an associated EAS system.

An associated system which includes the marker assembly further comprises a sensor system including means for producing a light beam, means for detecting light reflected from the identification element for reading the optically readable information, and means for detecting light reflected from the optically detectable security element for authenticating the marker assembly. Such a system also includes an EAS means for verifying the status of the detection element and for selectively deactivating it.

Accordingly, an article to which the assembly is secured may be interrogated to determine the status of the EAS element and/or alter that status, the information carried on said intermediate layer may be optically read, and the authenticity of the security element may be determined. A certain response to any of these operations may then allow the response to any of the other operations to be modified.

BRIEF DESCRIPTION OF THE DRAWING

FIG. 1 is a perspective breakaway view of one embodiment of the marker/label assembly in accordance with the present invention;

FIG. 3 is a detailed cross-section of the marker/label assembly of FIG. 1, shown in conjunction with an optical detector.

DETAILED DESCRIPTION

Figure 2:
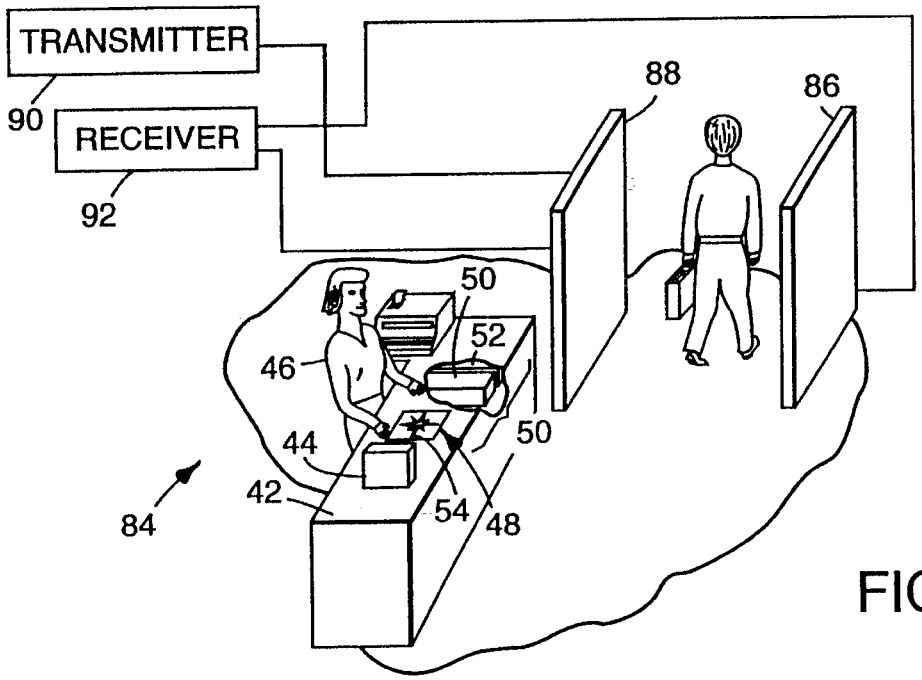
FIG. 2 is a composite perspective and block diagram of an embodiment in which the marker/label assembly of FIG. 1 would be used.

Referring to FIG. 1 of the drawing, a preferred marker/label assembly 10, in accordance with the present invention, broadly includes a laminate which includes an optically detectable element in conjunction with an electronic article surveillance marker element. Thus, as shown in FIG. 1, the assembly 10 includes an optically detectable sheet 12 formed of a layer of retroreflecting beads 14, some of which are highly reflectorized so as to present regions 16, 16', and 16", having intensely retroreflective properties. In contrast, the remainder of the beads, shown generally as area 18, are treated and, hence, exhibit less intense retroreflective properties. Secured by an adhesive layer 20 is a second optically detectable sheet 22 in which a conventional bar code 24, such as the ubiquitous UPC label or the like, is printed. Since the top sheet 12 containing the retroreflecting beads is substantially transparent to diffuse light, viewing the marker with such light will enable the light to be transmitted through the bead-containing sheet 12, such that the bar code 24 in the second sheet 22 may then be viewed.

The sheet 22 is coupled by an adhesive layer 26 to an electronic article surveillance marker 28 which is formed of first and second ferromagnetic sheets 30 and 32. Preferably, as set forth in U.S. Pat. No. 4,967,185, such a marker, now known as a "QUADRATAG" marker as manufactured and sold by Minnesota Mining and Manufacturing Company, may include a first sheet 30 of a low-coercive force, high-permeability material, and a second sheet 32 of remanently magnetizable material. The first sheet 30 is preferably formed of permalloy configured to have a plurality of narrow regions within which magnetic flux will be concentrated by the larger regions extending in the corners of the tag.

The second sheet 32 is preferably made from Arnokrome™, an iron, cobalt, chromium and vanadium alloy marketed by Arnold Engineering Co., Marengo, Ill., such as the Alloy "A" described in U.S. Pat. No. 4,120,704, which is assigned to that company. In a particularly desired configuration, a sheet of such material may be heat-treated to provide a coercive force of approximately 80 oersteds (6400 A/M). Other alloys having coercive forces in the range of 40 to 200 oersteds (3,200–16,000 A/m) are likewise acceptable. Such a material, when magnetized, alters the characteristic response produced by the first sheet 30, thereby deactivating the marker when interrogated in an associated anti-electronic article surveillance system.

The EAS marker 28 is in turn coupled by a pressure-sensitive adhesive 34 to a release liner 36 such that when the assembly 10 is to be attached to an article, the release liner 36 may be removed and the assembly attached to the appropriate article by the pressure-sensitive adhesive 34.

Figure 2A:
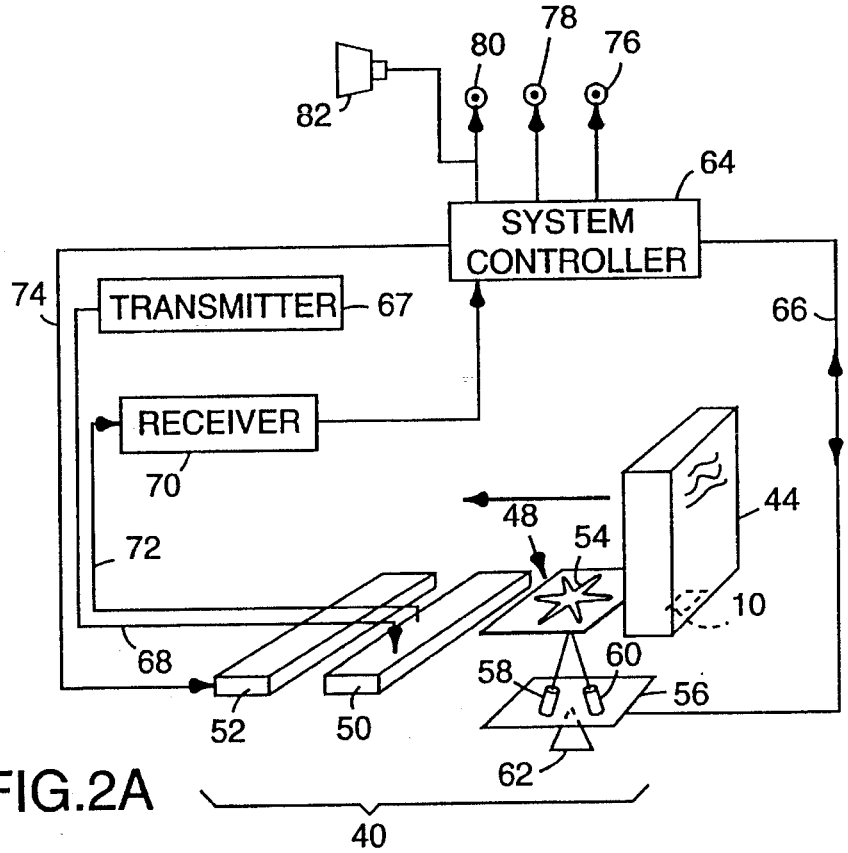
FIG. 2A is a combined block and functional diagram of that system expanded from that shown in FIG. 2.

The assembly 10, once secured to an article, is used with a sensor system 40 as shown in FIGS. 2 and 2A. As there shown, the sensor system will preferably be installed in conjunction with a checkout counter 42 such as conventionally used in a retail store cashier station. Thus, the counter 42 will be adapted to receive articles, such as the article 44 upon which an assembly 10 has been attached. The article 44 is there shown with the assembly 10 positioned face down on the counter 42. As is conventionally done, a clerk 46 will then manually move the article 44 past an optical scanner shown generally as 48. After the article 44 is moved past the scanner 48, it then passes adjacent a EAS verifier unit 50 and thence past a EAS deactivator 52 whereupon a customer may then be permitted to take possession of the article.

In FIG. 2A, the optical scanner, shown generally as element 48, may be seen to include a multi-directional window 54 such that the assembly 10 may be scanned regardless of its horizontal orientation as it passes the scanner. Positioned below the counter will be an optical scanner/pivoting assembly 56, which includes a first optical unit 58 containing a light source and a photo cell adapted to produce a light beam and to detect retroreflected light. The scanner 56 also includes a second photo cell 60 positioned to receive non-retroreflected light reflected at an angle from the light source within the unit 58. The scanner 56 is further mounted on a pivoting mechanism 62 such that the light may be scanned across the multi-dimensioned window 54.

As shown in FIG. 3, the scanner 56 is positioned such that the combined light and source photo cell 58 is directed upon an assembly 10 such that light retroreflected from the beads 14, of which only the optically responsive portion is shown, is directed into the photo cell within the unit 58. Some of the beads 14' are treated to have film 62 to provide regions of higher retroreflectivity from that of the remainder of the beads 14. In contrast, light diffusely reflected off the bar code 24 provided in the second layer 22 may be diffusely reflected into the photo cell 60.

Again, as shown in FIG. 2A, the verifier 50 is positioned to detect the status of the EAS marker 28. Thus, it contains magnetic field-producing and detector coils and associated detection electronics, simulating the conditions in an actual EAS system, so that the status of the marker may be determined. Such a verifier may, for example, be a Model 463 assembly manufactured by 3M Company. Once the status of the marker is verified and a determination has been made that the article may be passed on to the patron, the marker may then be deactivated by passing it by the deactivator unit 52. Such a unit typically contains an electromagnetic coil for producing a DC magnetic field so as to remanently magnetize the second magnetic sheet 32 of the EAS marker assembly 28.

Further shown in symbolic form in FIG. 2 are the associated electronic units which further comprise the system of the present invention. Thus, a system controller 64 provides master control for the system, which, via signal buss 66, both controls activation of the light scanning unit 56 and processes the signals from the respective photo cells 58 and 60. Analogously, the verifier 50 will be energized by a transmitter supply 67, and the signals produced by the verifier will be processed within a receiver 70. The appropriate signals therefrom will also be coupled to the controller 64. Also, the controller 64 will control the energization of the deactivator unit 52 via a control buss 74. As discussed in more detail in conjunction with the operation of the system set forth hereinafter, appropriate indicating signals to the respective indicator lights 76 and 80, as well as to an audible buzzer 82, will similarly be under the control of the system controller 64.

In operation, as an article 44 is passed over the optical scanning unit 56, the bar code may first be detected by the photo cell 60 and a digital representation of that code coupled to the controller 64. If logic within the controller indicates that a bar code has been properly scanned, the system logic then allows the next signal to be processed.

This signal in turn will be that produced from the retroreflective sheet 12 of the marker, and an appropriate signal from the photo cell 58 will result from the detection of a series of high and low signals of a particular amplitude and characteristic. This signal will be processed within the system controller 64 to indicate that the article is authentic and is, therefore, to be further processed. The presence of a verified bar code will be indicated by energization of the indicator light 76, while that of an authenticated retroreflective code will be indicated by energization of the indicator light 78.

As the clerk 46 next transports the article past the verifier 50, the status of the marker portion of the assembly will be determined. Assuming that the magnetic field produced by the transmitter unit 67 results in a characteristic response from the marker being detected within the receiver detector unit 70, and assuming that the appropriate bar code and authentication signals have been previously received, the controller 64 will provide a signal on buss 74, thereby energizing the deactivator 52 to deactivate the marker. At that point, the indicator light 80 and an optional buzzer,.82 are energized to notify the clerk that a complete transaction has taken place.

Upon appropriate deactivation of the marker, a patron may then carry the articles containing the deactivated markers through an electronic article surveillance system. Such a system 84, shown in FIG. 2, includes a pair of coil panels 86 and 88 positioned near the exitway from the facility, together with the transmitter and receiver apparatus 90 and 92, and may, for example, be the Model 3300 electronic article surveillance system manufactured by 3M Company.

While the system of the present invention described herein above has been described primarily in conjunction with a counter-mounted unit, it is similarly within the scope of the present invention that hand-held optical scanners may similarly be utilized. Likewise, while a multi-directional scanning facility is there depicted, such a hand-held unit would be equally adapted to be used in conjunction with marker assembly used in which the orientation of the optical units are known and, hence, a scanning unit shown in FIG. 2 would not be necessary.

It will also be recognized that the integrated system of the present invention may not always be desirably used in its entirety, such as in instances where articles of lower level security may be processed. In such cases, it may be desired to detect only a conventional bar code and/or a conventional EAS marker, without requiring the simultaneous processing of both retroreflective and EAS-based signals. In such an instance, that portion of the system directed to one or the other feature may be deactivated.

While not specifically indicated, it is similarly anticipated that the system controller 64 may be coupled to a centralized computer/inventory control system maintained by the facility to thereby automatically provide inventory information as well as current pricing information to the clerk 46.

The marker assembly of the present invention has been described hereinabove only in the context of a "QUADRATAG" type ferromagnetic EAS marker. The present invention also recognizes that such a marker assembly may also include elongated ferromagnetic markers and non-magnetic EAS markers, such as those based on microwave and radio frequency detection.

What is claimed is:

1. A marker assembly adapted to be secured to an article for use with a composite article surveillance and authentication system, said assembly comprising a) an identification element bearing optically readable information indicative of the article to which the marker is to be secured, b) a substantially transparent, optically detectable security element overlying said identification element and having means integrally associated therewith for thwarting counterfeiting or other unauthorized duplication, and c) a dual status deactivatable electronic article surveillance (EAS) detection element positioned beneath said identification element and having a first, activated state at which the element is adapted to be detected within an interrogation zone of the system and having a second, deactivated state at which such detection is prevented, wherein the information borne by said identification element is optically read, the authenticity of the security element is determined, and the status of said detection element is determined by a sensor system.

2. A marker assembly according to claim 1, wherein said security element comprises a sheet of substantially transparent retroreflective microspheres, portions of which microspheres have been differently treated to alter the degree of retroreflectivity so as to provide retroreflective legend areas and retroreflective background areas which are substantially indistinguishable under ordinary viewing conditions, but are clearly distinguishable under retroreflective viewing conditions.

3. A marker assembly according to claim 2, wherein said marker further comprises at least one remanently magnetizable element, which, when magnetized, changes a characteristic response produced by a responder element, thereby preventing its detection in said interrogation zone.

4. A marker assembly according to claim 1, wherein said detection element comprises a responder section of high-permeability, low-coercive force ferromagnetic material and a keeper section of remanently magnetizable ferromagnetic material which, when magnetized, alters a characteristic response produced by said responder section when in said interrogation zone.

5. A marker assembly according to claim 1, wherein said identification element contains UPC standard coded information.

6. A marker assembly according to claim 1, further comprising adhesive means carried by the rear surface of the assembly and a release liner removably adhered to said adhesive means.

7. A composite system for identifying, authenticating, and interrogating an article, comprising a) marker assembly adapted to be secured to said article, said marker assembly comprising i) an identification element bearing optically readable information indicative of the article to which the marker is to be secured, ii) a substantially transparent, optically detectable security element overlying said identification element and having means integrally associated therewith for thwarting counterfeiting or other unauthorized duplication, and iii) a dual status deactivatable electronic article surveillance (EAS) detection element positioned beneath said identification element and having a first, activated state at which the element is adapted to be detected within an interrogation zone of the system and having a second, deactivated state at which such detection is prevented, b) a sensor system including i) means for directing a light beam upon the marker assembly, ii) means for detecting light reflected from said identification element and for reading said optically readable information, and iii) means for detecting light reflected from said optically detectable security element and for authenticating said marker assembly, and c) EAS means for verifying the status of said detection element and for selectively deactivating it, wherein the information borne by said identification element is optically read, the authenticity of the security element is determined, and the status of said detection element is determined by a sensor system.

8. A system according to claim 7, wherein said security element comprises a sheet of substantially transparent retroreflective microspheres, portions of which microspheres have been differently treated to alter the degree of retroreflectivity so as to provide retroreflective legend areas and retroreflective background areas which are substantially indistinguishable under ordinary viewing conditions, but are clearly distinguishable under retroreflective viewing conditions, and said means for detecting light reflected from said security element includes means responsive to light retroreflected therefrom.

9. A system according to claim 7, wherein said detection element comprises a responder section of high-permeability, low-coercive force ferromagnetic material and a keeper section of remanently magnetizable ferromagnetic material which, when magnetized, alters a characteristic response produced by said responder section when in a said interrogation zone, and said EAS verification and deactivation means comprises field-producing and detection coils for detecting the presence of an active EAS marker element and means for magnetizing said keeper section for deactivating a said marker element.

* * * * *

UNITED STATES PATENT AND TRADEMARK OFFICE

CERTIFICATE OF CORRECTION

PATENT NO.: 5,477,219

DATED: 12/19/95

INVENTOR(S): Peter J. Zarembo and Walfredo M. Marfori

It is certified that error appears in the above-identified patent and that said Letters Patent is hereby corrected as shown below:

Col. 5, line 21, "buzzer,. 82" should read -- buzzer 82--.

Signed and Sealed this

Thirteenth Day of May, 1997

*Attest:*

*Attesting Officer*

BRUCE LEHMAN

*Commissioner of Patents and Trademarks*